US006418563B1

(12) United States Patent
Turner

(10) Patent No.: US 6,418,563 B1
(45) Date of Patent: Jul. 16, 2002

(54) MULTI-PURPOSE ORGANIZER AND PROTECTOR

(76) Inventor: Iris Turner, P.O. Box 22754, Trenton, NJ (US) 08607

( * ) Notice: Subject to any disclaimer, the term of this patent is extended or adjusted under 35 U.S.C. 154(b) by 0 days.

(21) Appl. No.: 09/666,788

(22) Filed: Sep. 21, 2000

(51) Int. Cl.[7] ..... A41B 11/00
(52) U.S. Cl. ..... 2/239; 2/16
(58) Field of Search ..... 2/239, 16, 158, 2/159, 162, 163, 170, 910, 911, 917, 161.1

(56) References Cited

U.S. PATENT DOCUMENTS

| | | | | | |
|---|---|---|---|---|---|
| 715,543 | A | * | 12/1902 | Bosworth | |
| 1,277,015 | A | * | 8/1918 | White | |
| 2,114,022 | A | * | 4/1938 | Jensen | 2/161 |
| 2,248,303 | A | * | 7/1941 | Morgenroth et al. | 2/239 |
| 2,315,889 | A | * | 4/1943 | Wells | 2/158 |
| 2,391,064 | A | * | 12/1945 | McCandless | 2/239 |
| 2,412,087 | A | * | 12/1946 | Herbert | 66/187 |
| 2,571,228 | A | * | 10/1951 | Freeman et al. | 2/158 |
| 2,687,528 | A | * | 8/1954 | Paul | 2/61 |
| 2,778,027 | A | * | 1/1957 | Bacon | 2/270 |
| 2,836,828 | A | * | 6/1958 | Henrikson | 2/158 |
| 3,334,356 | A | * | 8/1967 | Abel | 2/239 |
| 3,403,408 | A | * | 10/1968 | Helfer | 2/158 |
| 3,648,291 | A | * | 3/1972 | Pankers | 2/16 |
| 3,843,126 | A | * | 10/1974 | Bandy | 273/95 |
| 3,890,649 | A | * | 6/1975 | Diggins | 2/161 |
| 3,994,025 | A | | 11/1976 | Petroski | 2/20 |
| 4,034,979 | A | * | 7/1977 | Wester | 273/54 |
| 4,069,600 | A | * | 1/1978 | Wise | 36/10 |
| 4,176,407 | A | | 12/1979 | Goebel et al. | 2/20 |
| 4,531,241 | A | * | 7/1985 | Berger | 2/161 R |
| 4,785,478 | A | | 11/1988 | Mosley | 2/161 |
| 4,937,881 | A | * | 7/1990 | Heise | 2/16 |
| 5,168,577 | A | * | 12/1992 | Detty | 2/16 |
| 5,172,424 | A | | 12/1992 | VanBergen et al. | 2/158 |
| 5,603,116 | A | * | 2/1997 | Tronc | 2/2.15 |
| 5,603,122 | A | * | 2/1997 | Kania | 2/239 |
| 5,623,734 | A | | 4/1997 | Pugliatti | 2/239 |
| 5,642,525 | A | * | 7/1997 | Ketola | 2/16 |
| 5,761,746 | A | * | 6/1998 | Brown | 2/243.1 |
| 5,794,265 | A | * | 8/1998 | Reich | 2/125 |
| 5,864,886 | A | * | 2/1999 | Gergory et al. | 2/170 |
| 5,878,435 | A | * | 3/1999 | Kast et al. | 2/16 |
| 5,887,277 | A | * | 3/1999 | Lohman | 2/16 |
| 6,044,497 | A | * | 4/2000 | Richardson | 2/239 |

OTHER PUBLICATIONS

U.S. application No. 60/161,208, filed Oct. 22, 1999, Turner.

* cited by examiner

*Primary Examiner*—John J. Calvert
*Assistant Examiner*—Alissa L. Hoey

(57) ABSTRACT

A fingerless and toeless device for protecting an appendage against heat and cold and for eliminating the need to carry a wallet. The appendage device comprising an uninterrupted cylindrical body of stretchable fabric folded upon itself, and having an inner vertical seam, this seam houses an unstitched area perpendicular to a horizontal seam. Its length is such that it starts at the base of the fingers and ends at the wrist of a hand and the wearer's ball of the thumb is covered. Alternatively, it's length starts at a big toe of a foot and ends approximately at the heel of a foot. Its width is such that it can fit snugly over a wearer's hand of foot with no loss of circulation.

2 Claims, 9 Drawing Sheets

4/9

7/9

MULTI-PURPOSE ORGANIZER AND PROTECTOR

BACKGROUND OF THE INVENTION

This invention relates generally to articles of clothing and specifically to a purpose organizer and protector.

The uninterrupted fingerless article of clothing is a novel multi-purpose organizer and protector product that solves numerous problems. First, in the past everybody, both civilians, as well as military personnel, both desk as well as field personnel involved in work, sports, and leisure activities, had very little to choose from when it came to protecting their palms from both cold weather and sun-heated surfaces.

Gloves, mittens and mitts are usually worn in very cold temperatures, are too cumbersome, bulky, ugly, and inconvenient. Furthermore, certain palm, hand and foot coverings and protectors originally invented to allow freedom of the fingers and toes, add further problems. They restrict the fingers and toes with tight finger and toe slots, and require a lot of fuss, time, and attention to get them on and off. Furthermore still, they do not cover the entire surface of a palm of a hand, do not cover the back of a hand, and the sides of a palm of the hand, do not cover the ball of a thumb, all of the above, or a combination thereof.

Also, past multi-purpose fingerless palm and hand protectors and other multi-purpose palm and hand coverings and protectors share some of all the above listed disadvantages. Most people are too embarrassed to wear them for these obvious reasons, and so suffer the cold temperatures the best way they can. These chilly-hand sufferers consistently and vigorously rub their hands together for warmth, almost as if in tune to a dance.

Second, handling hot objects such as a sun-exposed steering wheel, continues to be a problem that results in scorched palms of the hands, and balls of the thumb, and yet most people feel they have to tolerate such discomfort, and wear existing inventions which have some of the above-mentioned disadvantages.

Third, there is no known novel protection for the inconveniences beach goers' face that they care to wear. During the hot summers, and very hot weather, most of them have nothing to protect the ball of a foot from the hot sands of a beach. These individuals go to the beach to have fun, to relax, and to experience a little freedom from everyday demanding schedules. Therefore beach goers do not want to wear bulky, cumbersome and restrictive shoes and slippers. They love to walk barefoot because it feels good to experience the sand under their feet. However, this tendency comes with a price, when the sand is hot: it often results in redness and tenderness of the ball of a foot. These tender-soles victims attempt to hop around, and make an embarrassing and cartoon-like mad dash on ball of foot; towards any available form of relief Fourth, an increasing number of people are struggling to stay healthy and do take pride in their health. Yet, they are finding it hard to maintain hygiene of their palms and back of their hands in a public environment. There is no known novel invention that prevents the skin of the entire palm, and the back of a hand from touching a dirty public bathroom door, in order to open the door to get in and out. The: inconvenience is greater when the public bathroom door has a knob. These knobs are usually disgustingly wet from people in a rush to get out of the bathroom.

Similarly, after a couple of rides in an amusement park, it is amazing how dirt and grime gets on the palms and back of the hands. When it is time to eat, the long walk to the crowded bathrooms to wash hands seems like a feat, so most people just dust off their palms and hands, hope they will not get sick, and commence eating. In addition, another problem originates from fatigue when a seat is not always readily available: tired people sit on any available structure, and some of them lean against a wall. Often, these actions involve the use of the palms of the hands. These problems challenge hygiene of the palms and back of the hands in a public environment.

Fifth, certain items of apparel are so important that they can cause some embarrassment, if they are not organized and maintained. These are haberdasheries such as socks, hosiery, and underwear. Many of us have seen people who rush in to work with mismatched socks and stockings. Also, one sock and one stocking usually gets missing, and the other one would have to be thrown away. Underwear is usually in a pile, in an organized mess. All these items are legendary in their ability to look disorganized even after they have been neatly folded. This is because these items are usually loosely organized.

The most devastating to women is pantyhose and stockings with runs in them. Ask any woman, and she will tell you that a run in her hosiery can ruin her day. The feeling is similar to breaking a fingernail. This is because for years, wearing hosiery has been made to be a status symbol for women. Women wear hosiery to show off their lovely legs, and also to look professional at work. However, some pantyhose and stockings can run within the hour! Women continue to buy more expensive hosiery, with the hope that those will not run too.

Nevertheless, those expensive stockings continue to fail women every time. Women continue to spend fortunes replacing their pantyhose and stockings for these reasons. It is a known fact that some women have resigned themselves to the fate of constantly replenishing their supply of hosiery. Also, that both men and women constantly replenish their supply of socks. They believe that the best way they can handle these problems is to avoid contributing to the problem. What they do not have, is a product that will help maintain organization, and that does not itself contribute to snagging and runs.

No product or prior art has been found which addresses all the above concerns of consumers. Only a novel invention can consider a solution to all of the above concerns. Such a product would gain popularity and loyalty from the consumer public.

Petroski, U.S. Pat. No. 3,994,025 shows a hand protector which is reversible and starts from the interstices or web of the fingers to the top of the ball of a thumb. Although this hand protector provides protection to the upper portion of the palm and back of a hand, it exposes the entire ball of a thumb as well as a substantial portion of the lower half of the palm of the hand. Furthermore, it covers neither the tops nor the ball of a foot. Additionally, the hand protector was not designed for wear on both the hands and feet. Therefore the structure and design of the hand protector is not suitable.

Van Bergen et al, U.S. Pat. No. 5,172,427 shows a fingerless mitten with a flap to release the fingers so that the mitten can be worn at the wrist. This structure provides an opportunity to release the fingers, but is cumbersome, bulky, ugly, and requires a lot of fuss, time, or attention to manipulate. Unfortunately, once the fingers are released, no coverage for the hand exists at all. Neither the palm, nor the back of the hand is protected. If worn over the toes, the flap might cause the wearer to trip on it.

Furthermore, the gathered material resulting from releasing the flap would cause the wearer to walk off-balance, and cause great discomfort across the area of the big toe. Additionally, the fingerless mitten was not designed for wear on both the hands and feet. Therefore, the structure and design of the fingerless mitten is not suitable.

Mosley, U.S. Pat. No. 4,785,478 shows a sun glove which only covers the back of a hand. It is specifically designed to expose the palm of a hand to the elements. Also, the sun glove requires a lot of fuss, time, and attention to get each of the five loops positioned around each finger. It is obvious that this sun glove does not cover the palm of the hand at all, and will give no protection to the toes of the foot, if worn. Additionally, the sun glove was not designed for wear on both the hands and feet. Therefore, the structure and design of the sun glove is- not suitable.

Goebel et al, U.S. Pat. No. 4,176,407 shows a hitting mitt with a flexible pad structure and a hole on one side for insertion of a thumb. Although suitable as a hitting mitt because it provides a cushion against impact, this hitting mitt exposes the entire thumb, and does not cover the entire surface of the palm of a hand. Furthermore, the wearer will constantly have to look for the hole in the hitting mitt to properly insert the thumb. Also, because of the cushioning pad structure, this hitting mitt is cumbersome, and bulky. Use of the hitting mitt for regular activities will hamper performance of the hand.

Furthermore still, this hitting mitt will not fit easily and comfortably over a foot, and does not cover the ball of a foot. The hitting mitt is too rigid to perform any of these tasks. Any attempt to try to fit it over the foot would result in an awkward fit. It would barely get past a big toe of the foot. Also, the hole for the thumb will expose the ball of the foot to hot sand and hot surfaces. A person would be more likely to keel over when walking on the hitting mitt. In addition to that, the hitting mitt was not designed for wear on both the hands and feet. Therefore the structure and design of the hitting mitt is not suitable.

Pugliatti, U.S. Pat. No. 5,623,734 shows a pedicure sock for keeping the foot warm, that has restricting stalls to separate each toe. Although suitable for keeping the foot warm during a pedicure, this pedicure sock is specifically designed to expose the toes of the foot while restricting them. It has restricting toe slots, which require a lot of fuss, time, and attention to get them on and off Furthermore, the pedicure sock does not cover the palm of a hand. The back of a hand is not protected either. Also, its awkward structure will not fit over a hand, and it will be impossible to use the hands for any activities. In addition to that, the pedicure sock was not designed for wear on both the feet and the hands. Therefore the structure and design of the pedicure sock is not suitable.

Other advantages of my invention will become apparent through the following specification and claims taken in conjunction with the accompanying drawings.

An organizer to maintain and organize haberdashery such as small apparel. It is also a fingerless palm, hand, toes and toe soles protector. A cylindrical body which fits snugly on the human hand and foot. An alternative embodiment has a somewhat wedge-shaped structure.

OBJECTS AND ADVANTAGES

Accordingly, besides the several objects and advantages of my invention described in the above patent, several objects and advantages of the present invention are:

(a) To solve at least five of consumers' concerns which have not been completely solved by existing inventions.

(b) To provide field personnel, including the military with a product, which can be doubled up to cover more specific areas of the hands and feet that need coverage the most.

(c) To provide field and office personnel, including the military, with a product that is smaller, convenient, quick and easy to wear and remove, even in the dark.

(d) To provide office personnel with a product they can wear all year round when the air conditioners are turned on too high for their comfort.

(e) To provide consumers with a new product that looks athletic, is also aesthetically pleasing, and gives them a choice of selection.

(f) To provide consumers with a product that covers more of a palm, a thumb, and the back of a hand.

(g) To provide drivers with a product that prevents both the palm, and ball of the thumb from getting scorched during a period until the steering wheel of a car cools down.

(h) To provide beach goers with an opportunity to preserve their dignity on hot sand, and hot surfaces.

(i) To provide consumers with a product that is comfortable to wear, is one-size-fits-all, and does not restrict with tight finger and toe slots.

(j) To provide an aid to keep the palms and back of a hand clean in a public working and recreational environment.

(k) To provide a product that can maintain and organize small apparel, without contributing to snagging and runs.

(l) To provide a product that is economical and inexpensive.

(m) To provide the consumer with a product that is 'no-hassle' to wear, and which can be worn anyhow they want.

(n) Further objects and advantages are to provide a product that saves packing space on trips, is adjustable, has several different functions, saves time and gas money hunting for several different products that have all the functions of the protector and organizer, lends its advantages to conventional hand coverings and protectors, protects both the hands and feet during both hot and cold weather, gives consumers maximum utility, fills an existing market niche, and is strong enough to compete globally. Still further objects and advantages will become apparent from consideration of the ensuing description and drawings.

BRIEF DESCRIPTION OF THE SEVERAL VIEWS OF THE DRAWING

In the drawings forming a part of this application.

Figure 1A:
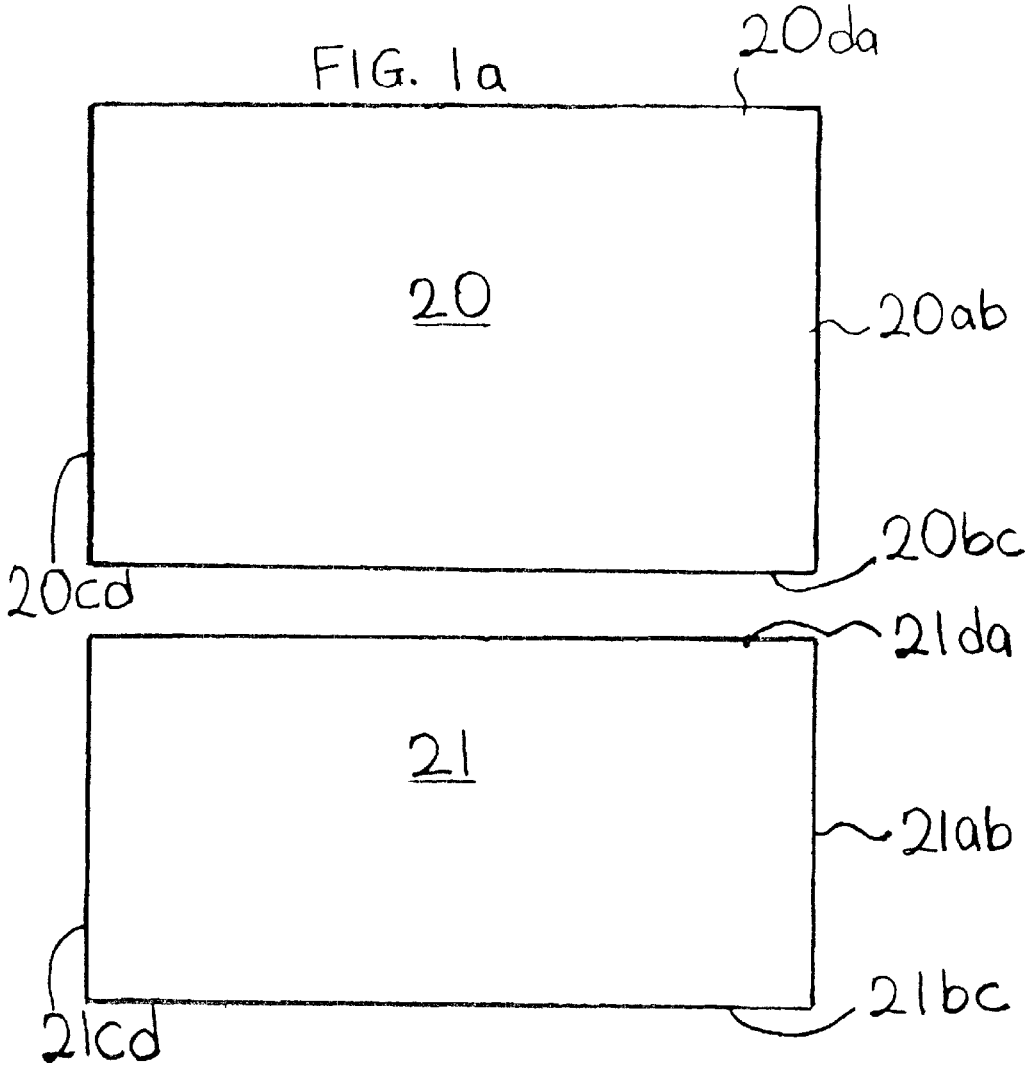
FIG. 1*a* is a plan view of the material after it has been cut.

| Reference Numerals in Drawings |
|---|
| 20 = taller piece |
| 21 = shorter piece |
| 20da = top widest side of taller piece |
| 21da = top widest side of shorter piece |
| 20ab = right side of taller piece |
| 21ab = right side of shorter piece |
| 20bc = bottom widest side of taller piece |
| 21bc = bottom widest side of shorter piece |
| 20cd = left side of taller piece |
| 21cd = left side of shorter piece |
| 22a = first horizontal seam (from top) |
| 22b = second horizontal seam (from bottom) |
| 23a = first beginner open end (left) |
| 23b = second beginner open end (right) |
| 24a = left innermost layer |
| 24b = right innermost layer |
| 24c = left outermost layer |
| 24d = right outermost layer |
| 25 = fold |
| 26 = small area left unstitched |
| 27 = vertical seam |
| 28 = first final open end |
| 29 = second final open end |
| 30 = first reversible side |
| 31 = second reversible side |
| 32 = double-stitching |
| 33 = box-shaped stitching |
| 34 = decorative borders |

-continued

| Reference Numerals in Drawings |
|---|
| 35 = fastener |
| 36 = narrowed open end |
| 37 = first wedge |
| 38 = second wedge |
| 39 = corner |
| 40a = first tapered ends |
| 40b = second tapered ends |
| 40c = first beginner tapered open end (left) |
| 40d = second beginner tapered open end (right) |
| 41 = first vertical seam (of wedge-shape) |
| 42 = second vertical seam (of wedge-shape) |
| 43 = crease |
| 44 = natural opening between the double layer |
| 45 = final tapered open end |
| 46 = final open end with seam |
| 47 = straight-line stitch |
| 100 = left hand |
| 110 = back of a hand |
| 200 = palm of a left hand |
| 202 = sides of a palm |
| 210 = right hand |
| 212 = palm of a right hand |
| 220 = wrist of a hand |
| 240 = base of the fingers |
| 260 = ball of a thumb |
| 280 = right foot |
| 290 = left foot |
| 300 = area of a foot used to tiptoe |
| 320 = big toe |
| 400 = socks |

Figure 5:
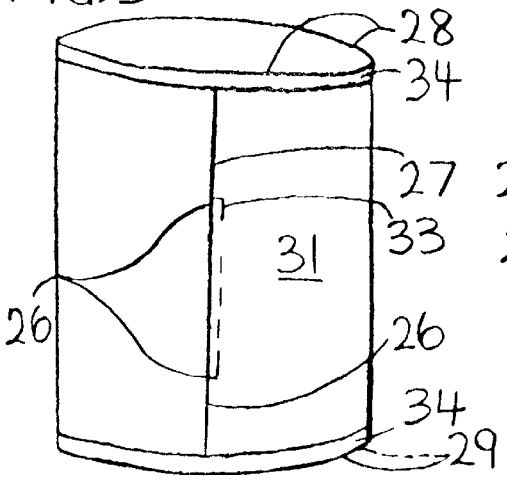
FIG. 5 is a perspective view of the second reversible side.

A preferred embodiment of the present invention is illustrated in FIG. 5. A cylindrical body of stretchable fabric with a first and second final open end 28 and 29 of equal width. The second reversible side 31 shown in FIG. 5 has decorative borders 34 at final open end 28 and 29, the second reversible side 31 has a gap or small opening left unstitched 26 at the vertical seam 27, which can be closed with box-shaped stitching 33. Small garments such as socks 400, pantyhose, and underwear are organized through this opening.

To manufacture the multi-purpose organizer and protector, any stretchable material that provides comfort, allows freedom of movement, and has shape retention is preferred. Although other materials with similar properties may be used, cotton with LYCRA available from DuPont of Wilmington, Del. is preferable.

FIG. 1*a*—Cut Two Pieces of Stretchable Material

Referring to FIG. 1*a* the drawing is a plan view of the material after it has been cut. One of the two pieces of stretchable material is shorter in height than the other piece. As a point of reference, we shall call this taller piece 20, and the shorter piece 21. A preferable method to get the two pieces of material 20 and 21 would be to fold 25 one piece of material, and cut along its fold 25.

Figure 1B:
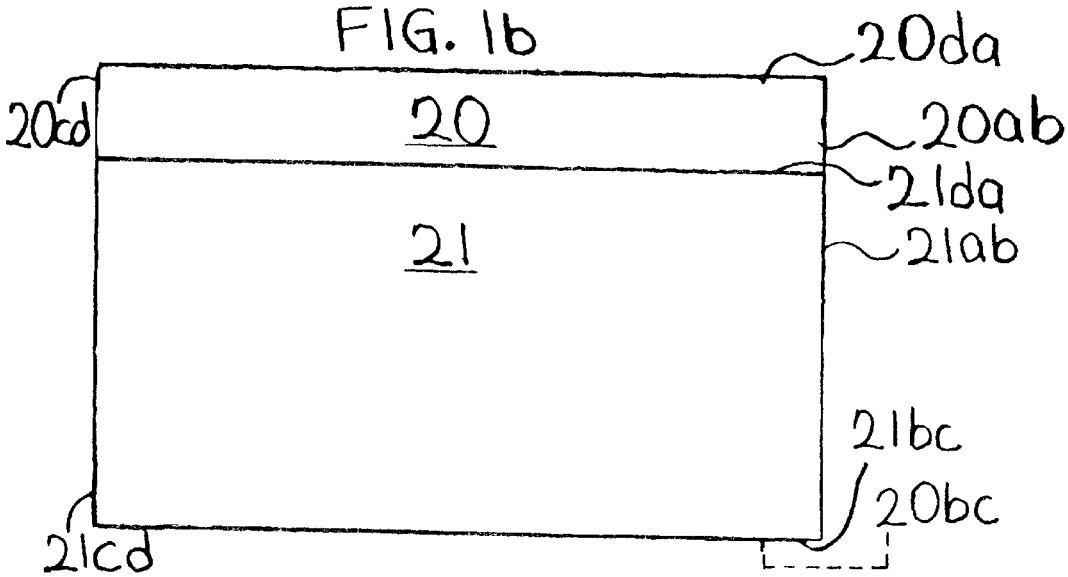
FIG. 1*b* is a plan view of the two positioned pieces.

FIG. 1*b*—Place the Two Pieces 20 and 21 Together

Referring to FIG. 1*b* the drawing is a plan view of the two positioned pieces. Place the right side of taller piece 20*ab* facing up, and the right side of shorter piece 21*ab* face down, so that both right sides of the material touch each other. Still referring to FIG. 1*b* the bottom widest side of taller piece 20*bc* should be even with the bottom widest side of shorter piece 21*bc*.

Still referring to FIG. 1*b* the top widest side of shorter piece 21*ba*, is a short distance below the top widest side of taller piece 20*da*. Basically, one piece is shorter than the other.

Figure 2:
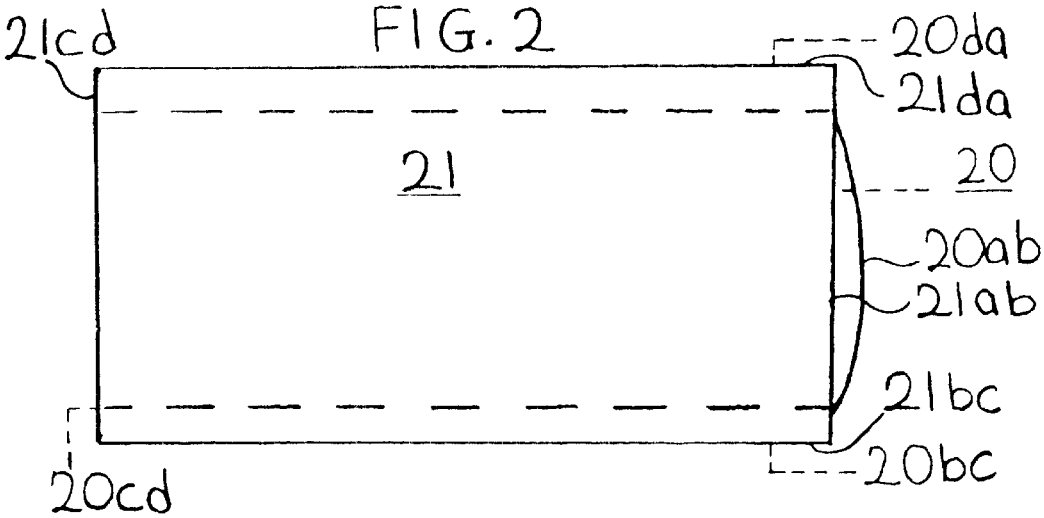
FIG. 2 is a plan view of the two pieces stitched together.

FIG. 2—Stitch the Widest Sides 20*da* to 21*da* and 20*bc* to 21*bc*

Referring to FIG. 2 the drawing is a plan view of the shorter and taller pieces 20 and 21. These two pieces have been stitched or sewn together at their widest sides. The top widest side of taller piece 20*da* is stitched to the top widest side of shorter piece 21*da*. This creates the first horizontal seam (from top) 22*a*.

Similarly, the bottom widest side of taller piece 20*bc* is stitched to the bottom widest side of shorter piece 21*bc*. This creates the second horizontal seam (from bottom) 22*b*.

Still referring to FIG. 2 the left side of taller piece 20*cd* and the left side of shorter piece 21*cd* now form an opening. This opening is the first beginner open end (left) 23*a*.

Similarly, the right side of taller piece 20*ab* and the right side of shorter piece 21*ab* now form another opening. This opening is the second beginner open end (right) 23*b*.

Figure 3:
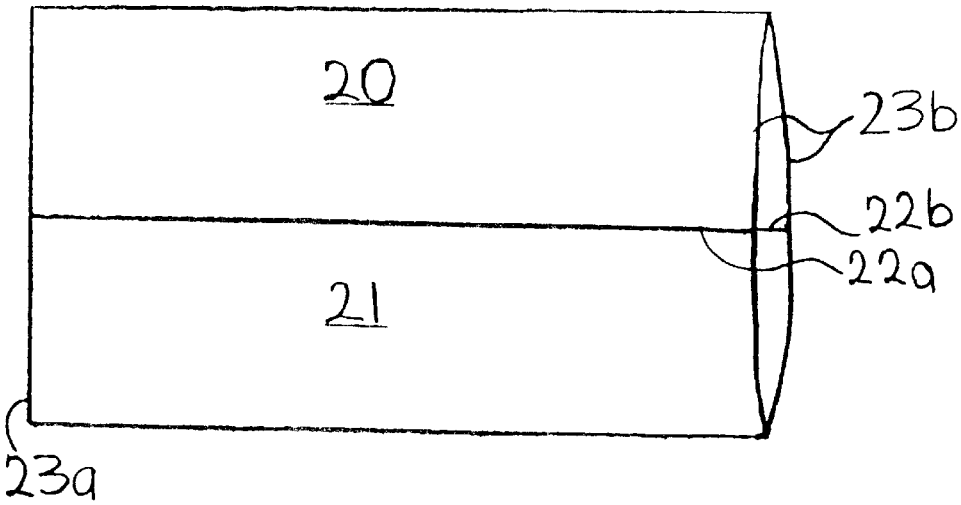
FIG. 3 is a perspective view of the middle-positioned seams.

FIG. 3—Reveal the Two Horizontal Seams now Created, 22*a* and 22*b*

Next, referring to FIG. 3 the drawing is a perspective view of the middle-positioned seams. The material is turned inside out, and straightened to remove any wrinkles. This action exposes the right side of the material. This action also reveals the first horizontal seam (from top) 22*a* and second horizontal seam (from bottom) 22*b*, which were just created.

FIG. 3—Reveal The Two Horizontal Seams Now Created, 22*a* and 22*b,* Continued Still referring to FIG. 3 turn the unfinished product around so that only the first horizontal seam (from top) 22*a* is facing up, and is visible. Position this horizontal seam 22*a* so that it lies in the middle of the unfinished product. By this movement, the second horizontal seam (from bottom) 22*b* is also positioned in the middle, except at the other side.

Still referring to FIG. 3 both horizontal seams 22*a* and 22*b* should now be positioned in the middle.

Figure 4:
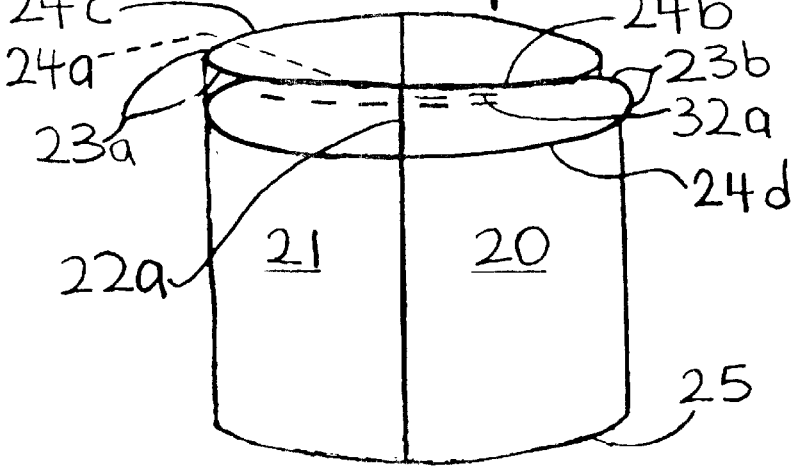
FIG. 4 is a perspective view of stitching the two beginner open ends.

FIG. 4—Hold the First and Second Beginner Open End 23*a* and 23*b* Together Referring to FIG. 4 the drawing is a perspective view of stitching the two beginner open end 23*a* and 23*b* together. Hold the first and second beginner open end 23*a* and 23*b* in each hand, and push them together. By doing so, a fold 25 occurs at the middle of the unfinished product. Also, the two ends of the first horizontal seam (top) 22*a* meet and form the left and right innermost layers 24*a* and 24*b*.

Held together at the innermost layers 24*a* and 24*b*, the first and second beginner open ends 23*a* and 23*b* appear to have oval shapes. The two ends of the second horizontal seam (bottom) 22*b* are on the outer areas, and form the left and right outermost layers 24*c* and 24*d*.

Still referring to FIG. 4 the first and second beginner open end 23*a* and 23*b* are stitched across at their edges to secure the aligned horizontal seams 22*a* and 22*b*. Begin by double-stitching 32 across the two ends of the first horizontal seam (from top) 22*a*. Start the stitching a short distance before the first horizontal seam (from top) 22*a*. End the stitching a short distance after the second horizontal seam 1,(from bottom) 22*b*. Use double-stitching 32 at the end also: it prevents the stitching from becoming undone.

FIG. 5—Invert the Material to Reveal the Vertical Seam 27

Referring to FIG. 5 the drawing is a perspective view of the second reversible side 31. Invert the material so that the stitching around the first and second beginner open ends 23*a* and 23*b* are now on the inside of the unfinished product. That stitching has resulted in a vertical seam 27 with an opening or small area left unstitched 26 approximately at its middle.

Still referring to FIG. 5, a somewhat cylindrical unit has been formed. Two reversible sides 30 and 31 have also been created, which have two final open ends: a first and second final open end 28 and 29. Decorative borders 34 appear at the top and bottom of its second reversible side 31.

Still referring to FIG. 5 stitch the remaining small area left unstitched 26. Box-shaped stitching 33 using longer stitches may be used. This last action should close the opening in the vertical seam 27 which formed the small area left unstitched 26.

Still referring to FIG. 5 entry by a human limb such as a hand and foot can occur from any one of its first and second final open end 28 and 29.

Still referring to FIG. 5 first and second final open end 28 and 29 are of equal width. The length of the embodiment covers a left or right palm of a hand 100 and 210 from the base of the fingers 240 to the wrist of a hand 220. Also, the length of the embodiment covers a left and right foot 290 and 280 from the big toe 320 to an area close to the instep.

Consequently, its construction allows the following also to be covered: sides of a palm 202, base of the fingers 240, ball of a thumb 260, back of a hand 110, and the area of the foot used to tip toe 300. Existing palm, hand, and toe coverings ignore coverage of some of these areas.

Operation of Main Embodiment—FIGS. 6, 7, 8 and 9

To Wear on the Hands

Figure 6:
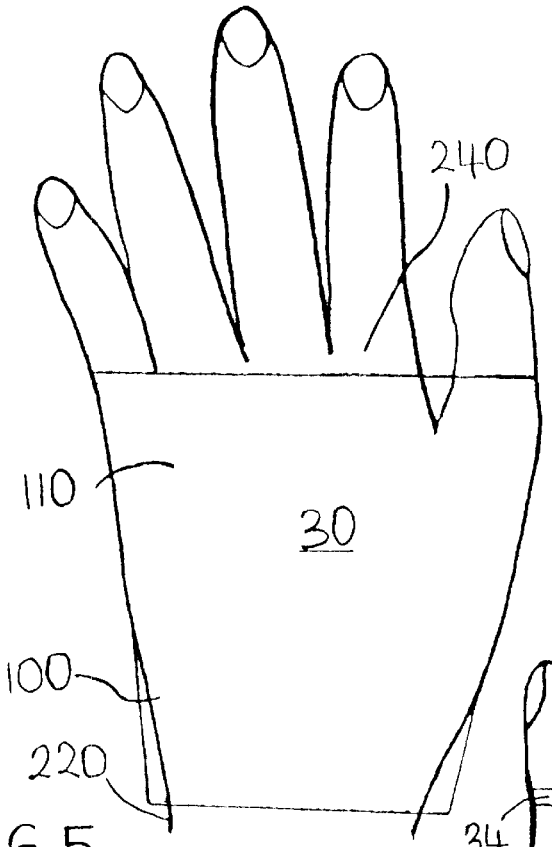
FIG. 6 is a plan cutaway view of coverage of the back of a hand.
Figure 7:
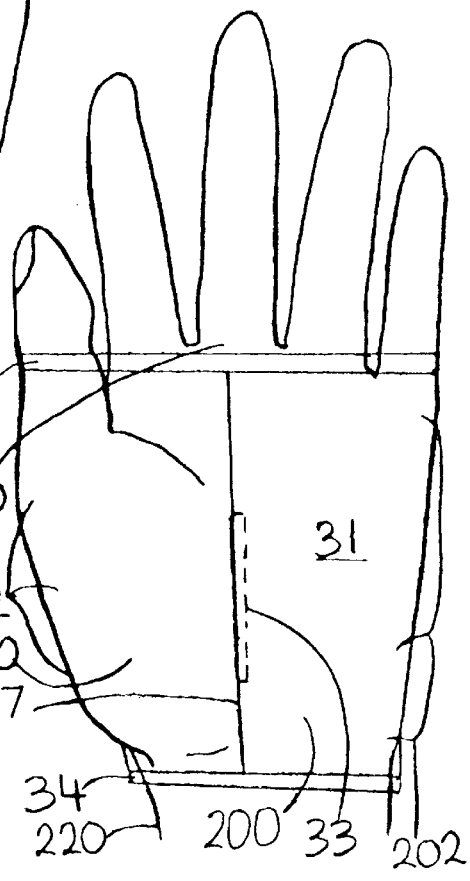
FIG. 7 is a plan cutaway view of coverage of a left palm.

Referring to FIG. 6 the drawing is a plan cutaway view of coverage of the back of a hand 110. It shows the second reversible side 31 of the embodiment. Referring to FIG. 7 the drawing is a plan cutaway view of coverage of the palm of a left hand 200. It shows the first reversible side 30.

To operate, hold the embodiment at any one of its first and second final open end 28 and 29. Hold the thumb and the fingers close together.

Referring to FIG. 6 again, insert a left hand 100 into any one of these final open end 28 and 29 until one end rests at the wrist of a hand 220, and the other end rests at the base of the fingers 240. Now, repeat the process with the right hand 210.

The ball of a thumb 260 is geographically a part of a palm of a hand 200. Therefore, the multipurpose organizer and protector achieves its goal of providing full coverage to the entire palm of a hand, whether during cold weather or hot.

Also, protection is provided to the gap between the fingers and the thumb. The fingers and thumb are left free and mobile.

To Wear on the Feet

Figure 8:
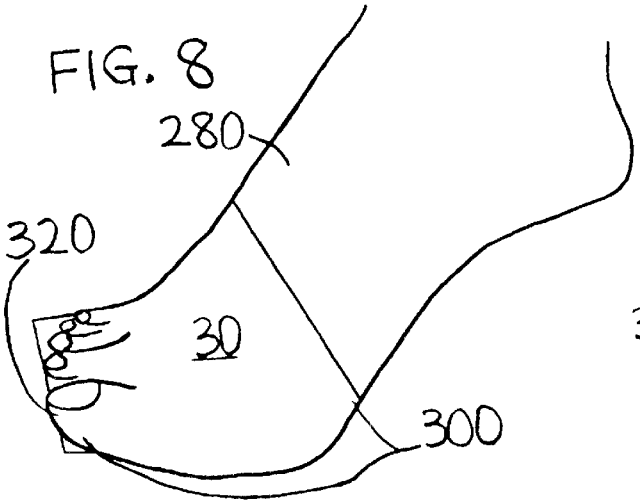
FIG. 8 is a side plan cutaway view of area used to tip toe.

Referring to FIG. 8 the drawing is a side plan cutaway view of the area of a foot used to tip toe 300. The embodiment is shown being worn on a right foot 280. To operate, hold one embodiment at any one of its two final open ends 28 and 29. Using both the left hand 100 and the right hand 210 hold each corner 37 of the embodiment. Raise the toes of a foot slightly, and slide the embodiment in a downward motion over the toes of the foot. Repeat the process with the left foot 290. The big toe 320 and other four toes of a foot are covered on the tops and soles. The entire area of the foot used to tip toe 300 is also covered. This area includes the soles of the toes, as well as the front area of the sole of a foot.

Therefore, walking on hot surfaces such as hot sand becomes manageable. Additionally, during cold weather, and at the office, out in the field, and at home, the multi-purpose organizer and protector gives protection, as well as added protection to areas of the foot needed by the wearer.

A few people may prefer a little less flexibility in the operation of their multi-purpose organizer and protector. These individuals may designate the area showing a seam FIG. 7 as the front of the embodiment, and the area showing no seams, FIG. 6 as the back of the embodiment.

Organizer

Figure 9:
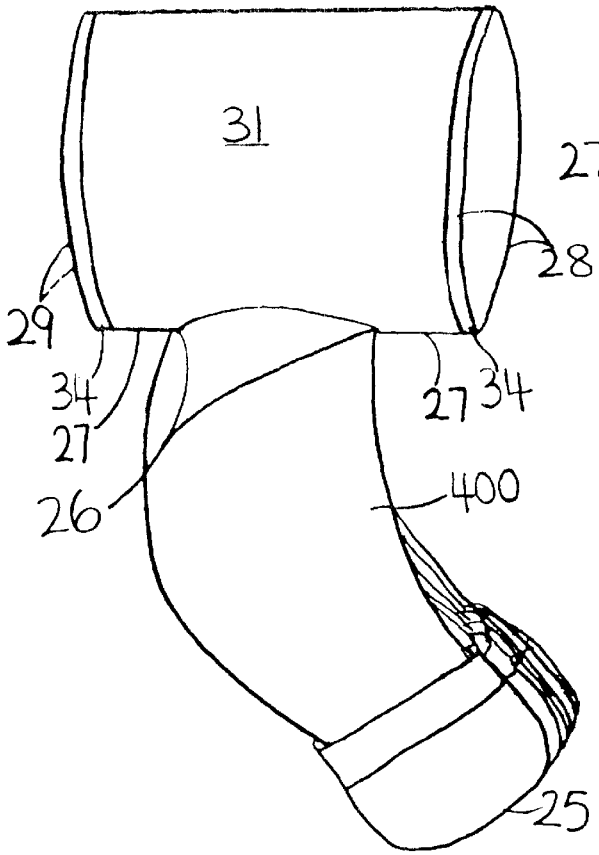
FIG. 9 is a perspective view of organized socks.

Referring to FIG. 9 the drawing is a perspective view of organized socks 400. To use the organizer function, remove the box-shaped stitching 33. The small area left unstitched 26 is an opening through which to insert and organize socks 400, hosiery and underwear. The following are the details of operation:

Socks 400

To organize socks 400, first secure a pair together by folding the top of one over the other. Next, tuck the foot ends of the socks 400 into the small area left unstitched 26 of the multi-purpose organizer and protector. As many as six pairs of socks 400 can be organized in one organizer and protector. Preferably, tuck the feet of all six pairs of socks 400 into the small area left unstitched 26. To remove the socks 400, hold the protector firmly with one hand at the small area left unstitched 26. Locate the particular pair you want to remove and tug gently with the other hand, at its folded tops.

Stockings

To organize stockings, follow the same process of folding as with socks 400 except also fold 25 the length of the stockings almost in two, so that its length is almost halved.

Next, insert the fold 25 of the stockings through the area left unstitched 26 of the multi-purpose organizer and protector. At least six pairs of stockings can be organized this way, so you can insert all of them at the same time: they look neater. To remove a pair of stockings, use the same process as with socks 400.

Pantyhose

To organize pantyhose, fold 25 the pantyhose vertically once, at the panty end. Next, fold 25 the length of the pantyhose almost in two. Continue as with stockings for organizing and removal.

Underwear—Thong

To organize thong underwear, pick it up by its rear strap and insert this strap into the protector at the small area that is left unstitched 26. To remove, hold the protector firmly with one hand at the small area left unstitched 26, and tug at the underwear with the other hand. A dozen pieces of underwear can be organized this way.

Doubling Up

During sudden drops in temperature, a second pair of the multi-purpose organizer and protector can be worn over an original pair, using the same processes. The location of the second pair can be anywhere the protection is needed the most. Similarly, a first pair of the protector and organizer can be pulled over a conventional palm, hand, and toe covering and protector, wherever it is needed the most. The second pair is then removed when the temperature rises sufficiently.

Removal for Laundering

When removing the multi-purpose organizer and protector, and especially in a situation where it has become extensively dirty or soiled, pull the protector down from the wrist of a hand 220. Continue by pulling it towards the base of the fingers 240 until it is almost doubled in two. Now, using a free hand, hold the protector at the fold 25 and slide it off the fingers. However, certain activities in general require disposable protective covering. The wearer should dispose of the multi-purpose organizer and protector and don a fresh pair.

Tips for Wear on the Hands and Feet

The decorative borders 34 are located at the second reversible side 31 as shown in FIG. 5. Therefore that side can be worn either on the feet only, or on the hands only. Doing so creates a striking contrast.

The following additional embodiments have the same processes of manufacture as the main embodiment, except that fasteners have been added:

Description and Operation of Additional Embodiments—FIGS. 10*a*, 10*b*, 10*c*, 12, 13*a*, and 13*b*

Figure 10A:
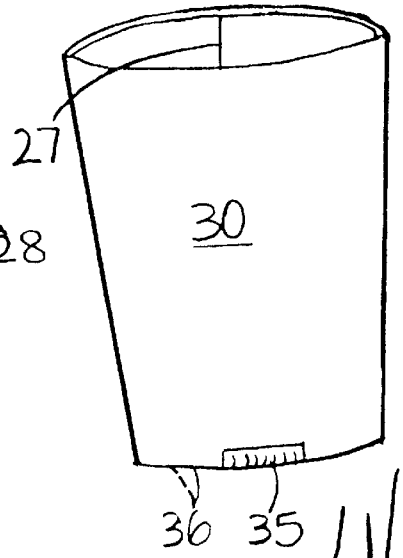
FIG. 10*a* is a perspective view of an additional embodiment.

Description—FIG. 10*a*

Referring to FIG. 10*a* the drawing is a perspective view of an additional embodiment. Two fasteners are centrally attached at one narrowed open end 36.

Operation—FIG. 10*a*

The narrowed open end 36 is preferably worn at the wrist of a hand 220 and at the toes of the foot. First, hold the embodiment at the location of a fastener 35 and slip the fingers through. For wear on the foot, hold the embodiment at the first final open end 28 with no fasteners and pull the embodiment over the toes.

Figure 10B:
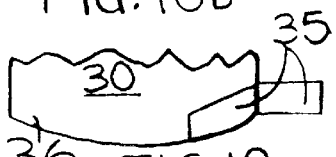
FIG. 10*b* is a plan view of a Velcro fastener on another embodiment.

Description—FIG. 10*b*

Referring to FIG. 10*b*, the drawing is a plan view of a Velcro fastener 35 on another embodiment. The fastener 35 is attached at one narrowed open end 36.

Operation—FIG. 10*b*

The narrowed open end 36 is preferably worn at the wrist of a hand 220 and at the toes of the foot, as with FIG. 10*a*.

Figure 10C:
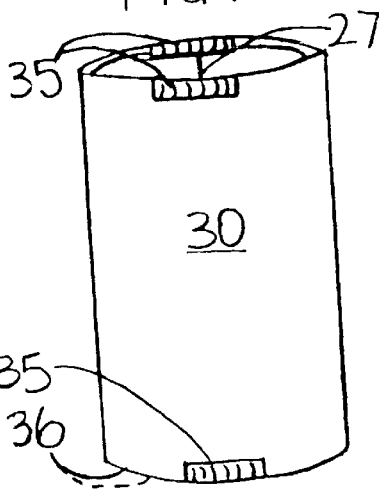
FIG. 10*c* is a perspective view of an additional embodiment.

Description—FIG. 10*c*

Referring to FIG. 10*c* the drawing is a perspective view of an additional embodiment. Two fasteners at attached at each narrowed open end 36.

Operation—FIG. 10*c*

Position the fasteners at the middle of the wrist of the hand 220, and the toes of the foot.

Figure 12:
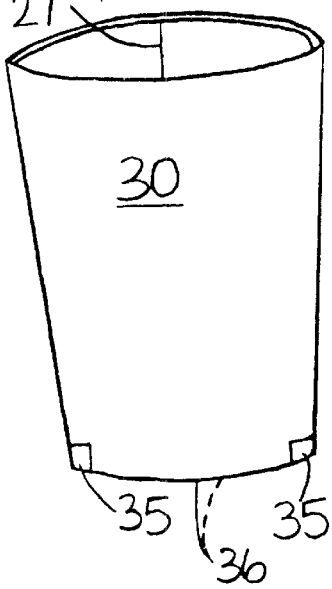
FIG. 12 is perspective view of another embodiment.

Description—FIG. 12

Referring to FIG. 12 the drawing is a perspective view of an additional embodiment. Fasteners are attached at two areas of one narrowed open end 36.

Operation—FIG. 12

Figure 11A:
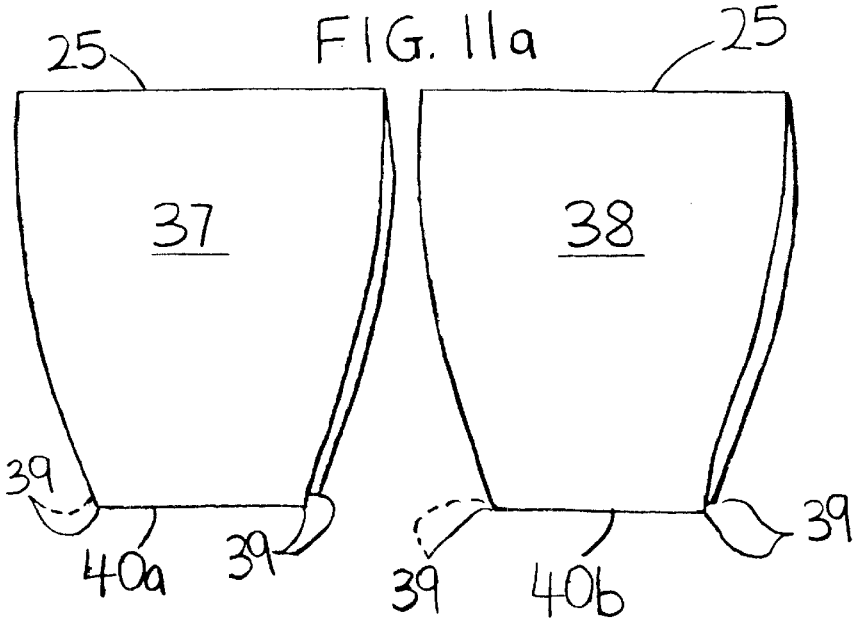
FIG. 11*a* is a perspective view of a first and second wedge.
Figure 11B:
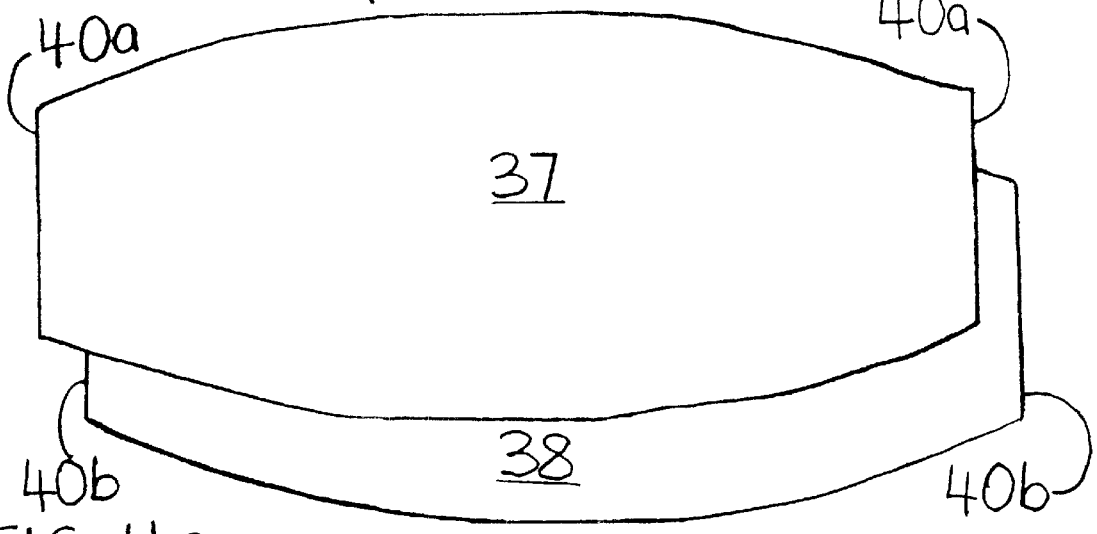
FIG. 11*b* is a perspective view of the unfolded pieces.
Figure 11C:
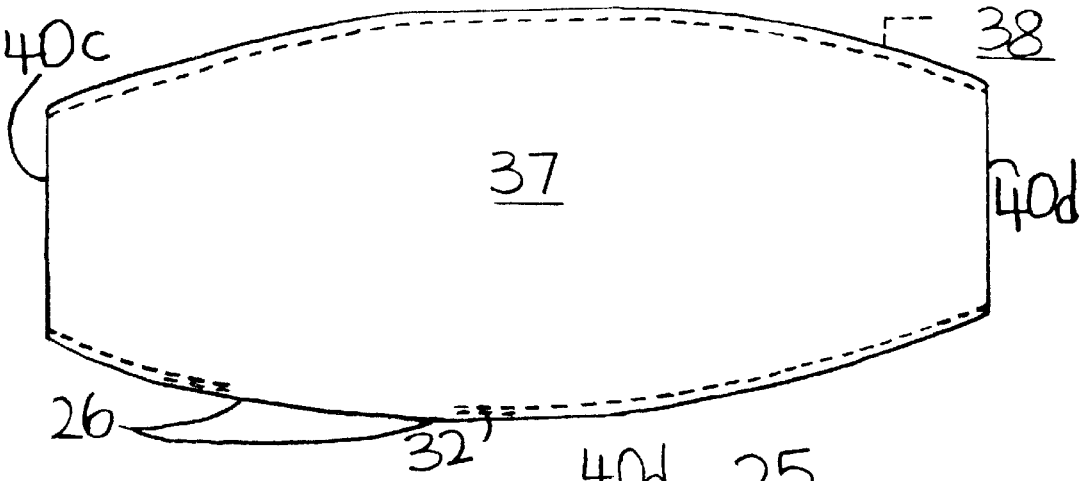
FIG. 11*c* is a perspective view of the two pieces stitched together.
Figure 11D:
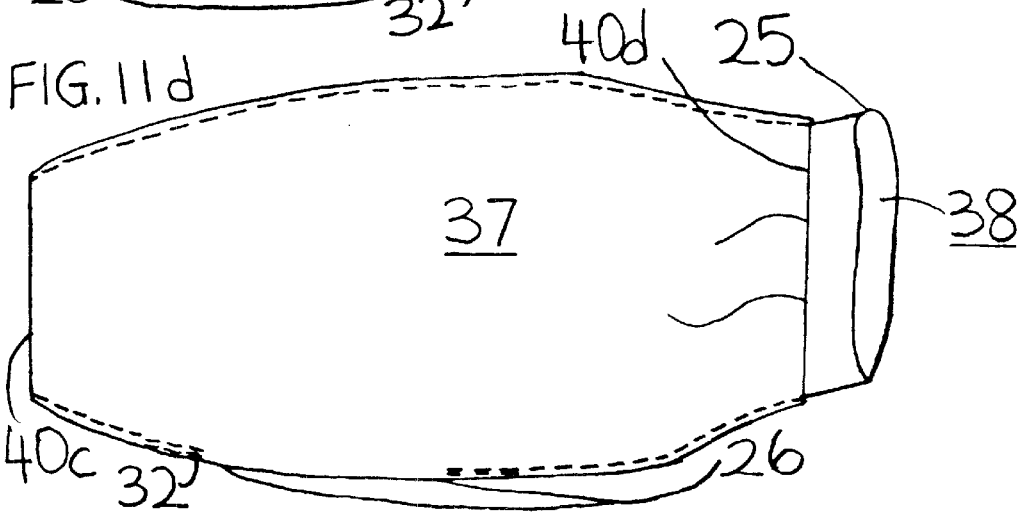
FIG. 11*d* is a perspective view of inverting onto its right side.
Figure 11E:
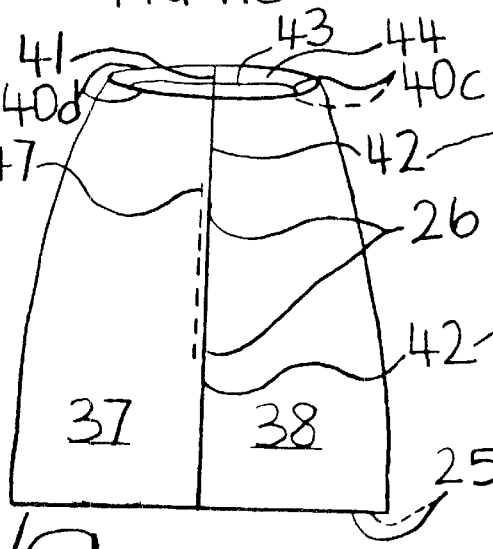
FIG. 11*e* is a perspective view of closed seam.
Figure 11F:
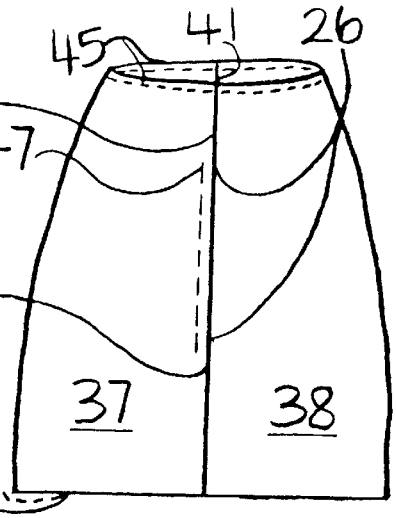
FIG. 11*f* is a perspective view of a crease at first beginner tapered open end.
Figure 11G:
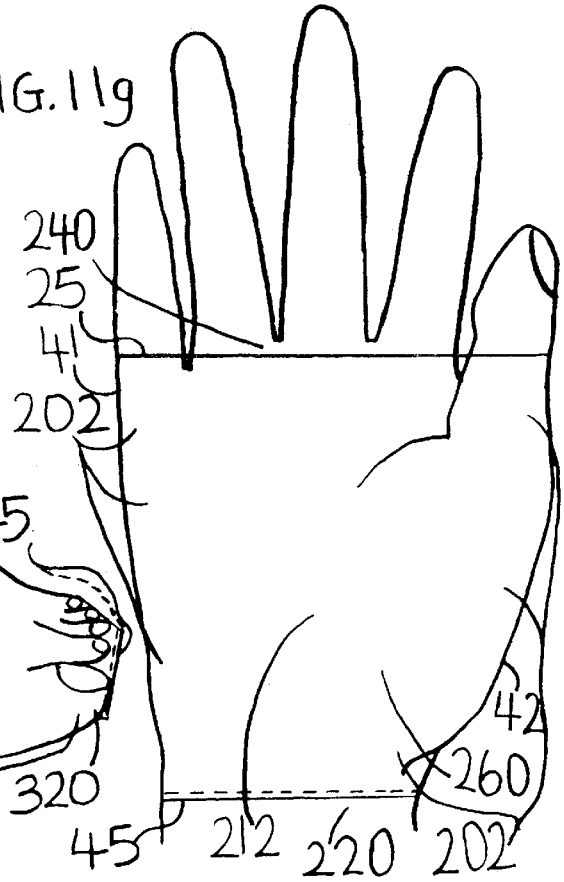
FIG. 11*g* is a plan cutaway view, closer fit at one open end.

Operation of this embodiment is the same as FIGS. 10*a*, and FIG. 11*g*. The only difference is that the fasteners are positioned at the corner 37 of the wrist of the hand 220, and the toes of the foot.

Figure 13A:
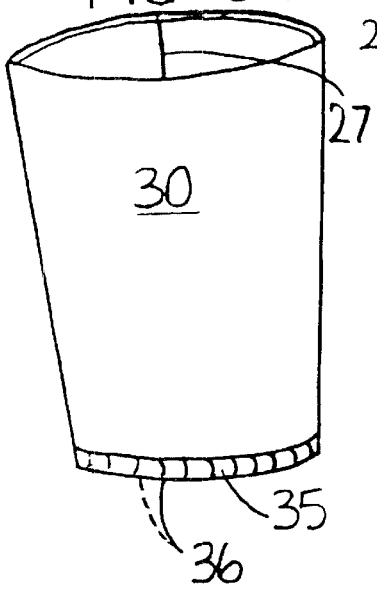
FIG. 13*a* is a perspective view of another embodiment.

Description—FIG. 13*a*

Referring to FIG. 13*a* the drawing is a perspective view of an additional embodiment. Fasteners are attached around the entire circumference of one narrowed open end 36.

Operation—FIG. 13*a*

To wear on a hand, hold the embodiment at the side with the fasteners and slip a hand through. To wear on the foot, pull the side with the fasteners over the toes.

Figure 13B:
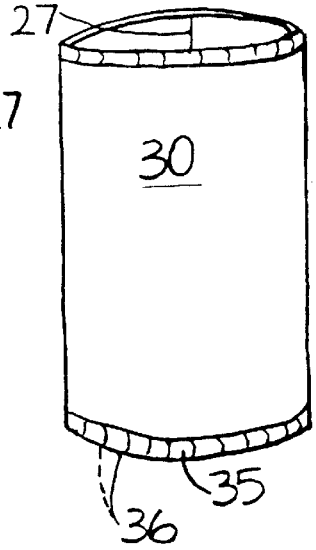
FIG. 13*b* is a plan view of another embodiment.

Description—FIG. 13*b*

Referring to FIG. 13*b* the drawing is a plan view of an additional embodiment. It has fasteners around the entire circumference of each narrowed open end 36.

Operation—FIG. 13*b*

The process of operation is the same as the main embodiment: insert a hand into the embodiment with the fingers and thumb held closely together. Slide the embodiment into position at the base of the fingers 240 and wrist of the hand.

Description of Alternative Embodiments, Tapered Protector and Organizer—FIGS. 11*a*–11*h*

The general idea for this reversible unit is the same as the main embodiment, except that each corner 37 of one end is reduced or cut to create a tapered or smaller width.

FIG. 11*a*—Two Pieces of Material are Folded in Two

Referring to FIG. 11*a* the drawing is a perspective view of a first and second wedge 38 and 39. Two pieces of stretchable material are each folded in two. The two pieces of material are then reduced or cut at each corner 37 of one end to decrease its width. The outcome is a first and second tapered end 40*a* and 40*b*, which are unfinished ends. The widest end is at the fold 25 of each wedge.

FIG. 11*b*—Straighten Each Piece Out

Referring to FIG. 11*b* the drawing is a perspective view of the unfolded pieces. Straighten each piece and lay them one over the other, right sides facing each other.

FIG. 11*c*—Stitch the Two Pieces Together

Referring to FIG. 11*c* the drawing is a perspective view of the two pieces of material stitched together at both sides. Leave a small area left unstitched 26 through which to organize small apparel. This area should preferably be located close to the end of one side. Use double-stitching 32 at the opposite ends of the small area left unstitched 26 so that the stitching does not become undone.

Still referring to FIG. 11*c*, the first tapered ends 40*a* are stitched to second tapered ends 40*b*. Two open ends have been created as a result: first beginner tapered open end (left) 40*c*, and second beginner tapered open end (right) 40*d*.

FIG. 11*d*—Invert Unfinished Product Onto its Right Side

Referring to FIG. 11*d* the drawing is a perspective view of inverting the unfinished product onto its right side. To do so, take a second beginner tapered open end (right) 40*d* and pull it down until it meets the first beginner tapered open end 40*d*. The unfinished product is halved by this action. The seams created by stitching both sides, now form a first and second vertical seam 41 and 42.

FIG. 11*e*—Close the Small Area Left Unstitched

Referring to FIG. 11*e*, the drawing is a perspective view of a closed seam. Close the small area left unstitched 26 with one straight-line stitch 47. Preferably, longer stitches should be used to allow them to be more easily removed. The wearer's removal of these stitches would then activate the organizer function of the embodiment.

Still referring to FIG. 11*e*, the drawing shows the natural opening 44 between a first and second beginner tapered open end 40*c* and 40*d*.

FIG. 11*f*—Stitch at Crease 43 of First and Second Beginner Tapered Open End 40*c* and 40*d*

Referring to FIG. 11*f*, the drawing is a perspective view of a crease 43 made at the first beginner tapered open end 40*c*. Fold 25 and crease 43 the edges of the first and second beginner tapered open ends 40*c* and 40*d*. Tuck these edges into a natural opening 44 between the double layers. A wide enough crease 43 is made so that the edges are not visible.

Still referring to FIG. 11*f* use the fingertips to assist you to pull the crease 43 taught for a straight and uniform crease 43. The first and second beginner tapered open ends 40*c* and 40*d* are facing each other within the natural opening 44 of the double layer. At this time, all the edges around the first and second beginner tapered open ends 40*c* and 40*d* are hidden from view.

Still referring to FIG. 11*f*, stitch along the crease 43. This action closes the natural opening 44 between the double layer.

A reversible protector with a final tapered open end 45 has just been created. Decorative borders 34 can be created or added for either a specific masculine or feminine look. If preferred, trimmings such as lace, embroidery, and other such trappings, including buttons, and also of any color, shape, size, thickness, length, and width can be used.

To Wear on the Hands

Operation—FIG. 11*g*

Referring to FIG. 11*g* the drawing is a plan cutaway view of a close fit at a final tapered open end 45. The drawing shows the palm of a right hand 212. The process of operation is generally the same as for the main embodiment.

Still referring to FIG. 11*g* to operate, hold the thumb and the fingers close together. Insert a right hand 210 into a final tapered open end 45 until it rests at the wrist of a hand 220. The other end should rest at the base of the fingers 240. Now, repeat the process with the left hand 100. Preferably, the seams of the protector and organizer are positioned at the sides of a palm 202.

However, some wearers may prefer a more flexible approach: to wear the wider end at the base of the fingers 240, and to position the seams at any area of the palm of a hand.

To Wear on the Feet

Figure 11H:
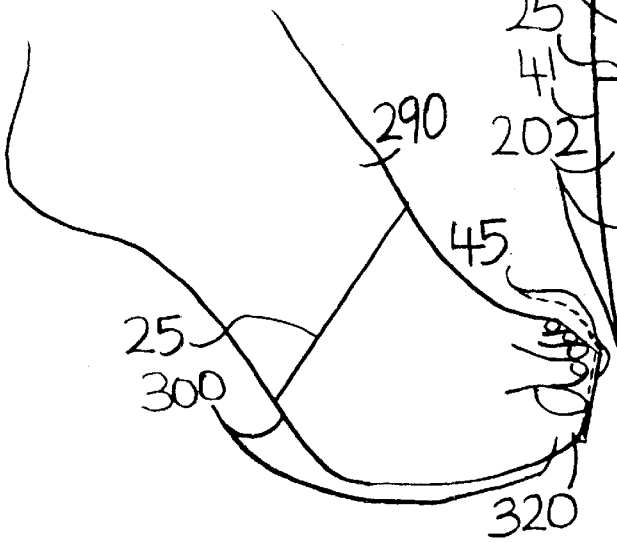
FIG. 11*h* is a plan cutaway view, close fit on one open end.

Operation—FIG. 11*h*

Referring to FIG. 11*b* the drawing is a plan cutaway view of a closer fit at a final tapered open end 45. The drawing shows a left foot 290.

To operate, hold one embodiment at its widest end. Using both the left hand 100 and the right hand 210 hold each corner 37 of the embodiment. Raise the left foot 290 slightly, and slide the embodiment in a downward motion over the toes of the foot. Repeat the process with the right foot 280.

The big toe 320 and other four toes of a foot are all covered on the tops and soles. The entire area of the foot used to tip toe 300 is also covered. This area includes the soles of the toes, as well as the front area of the sole of a foot. Preferably, the seams of the protector and organizer are positioned at the sides of the foot.

Operation—FIG. 11*h*

Again, some wearers may prefer a more flexible approach: to wear the embodiment with the wider end at the toes of the feet, and to position the seams wherever they prefer.

Figure 14A:
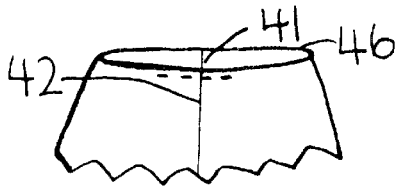
FIGS. 14*a* and 14*b* are perspective sectional views of other additional embodiments.
Figure 14B:
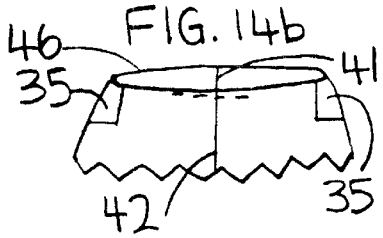
Figure 14C:
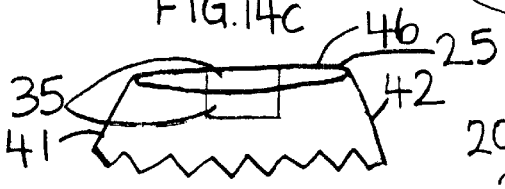
FIG. 14*c* is a perspective sectional view of another additional embodiment.

Description of Additional Embodiments,—FIGS. 14*a*, 14*b*, and 14*c*

Description—FIGS. 14*a* and 14*b*

Referring to FIGS. 14*a* and 14*b* the drawings are perspective sectional views of other additional embodiments. Both FIGS. 14*a* and 14*b* have a final open end with seam 46 around the majority of a final tapered open end 45.

To manufacture, both first and second vertical seams 41 and 42 are twisted around so that they are aligned. The first and second beginner tapered open end 40*c* and 40*d* are stitched together on the wrong side of the material. The remaining small area left unstitched 26 is then stitched closed. The difference between FIGS. 14*a* and 14*b* is that FIG. 14*a* has no fastener 35, while FIG. 14*b* has two fasteners at a final tapered open end 45.

Operation—FIGS. 14*a* and 14*b*

The process of operation is the same as for FIGS. 11*g* and 11*h*.

Description—FIG. 14*c*

Referring to FIG. 14*c* the drawing shows a perspective sectional view of another embodiment. It has a fold 25 at first and second tapered ends 40*a* and 40*b* even before both wedges are stitched together. Another variation of this embodiment has a fold 25 at a first and second beginner tapered open end 40*c* and 40*d* after both sides are stitched together. This way, a finished or final tapered open end 45 is already created before inverting the unfinished product onto the right side. Also, the result is a seamless final tapered open end 45, without stitches around its circumference.

Operation—FIG. 14*c*

The process of operation for FIG. 14*c* is the same as for FIG. 11*g*.

Figure 14D:
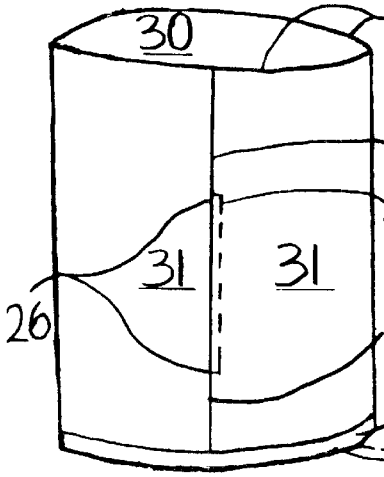
FIG. 14*d* is a perspective view of another additional embodiment.
Figure 14E:
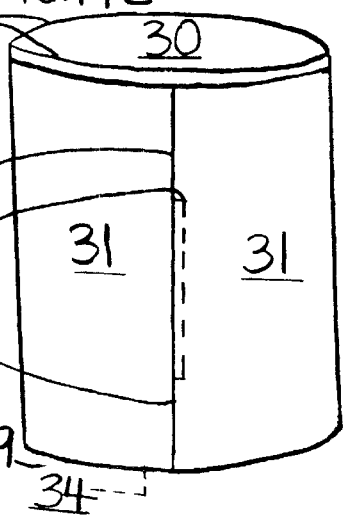
FIG. 14*e* is a perspective view of another additional embodiment.
Figure 14F:
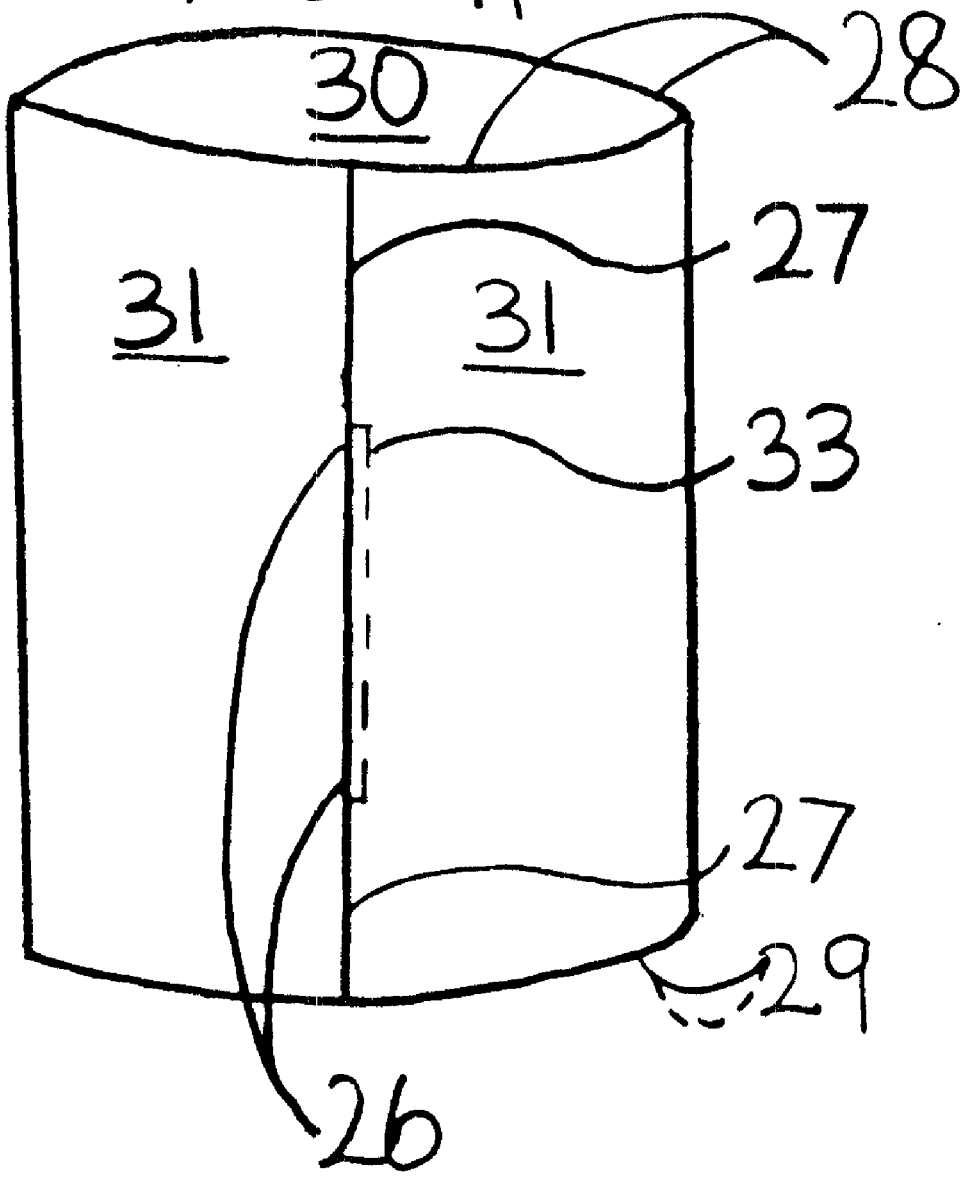
FIG. 14*f* is a perspective view of another additional embodiment

Description of Other Additional Embodiments of the Main Embodiment—One, Two and No Decorative Borders 34, FIGS. 14*d*, 14*e*, and 14*f*

Description—FIG. 14*d*

Referring to FIG. 14*d* the drawing shows a perspective view of another additional embodiment. This embodiment has only one decorative border at a second reversible side 31. The manufacturing process is the same as for the main embodiment. Two pieces of material, one shorter than the other, are used. However, fold 25 across any one horizontal seam 22*a* or 22*b*. Secure that position by stitching the area left unstitched 26.

Another manufacturing process uses two pieces of material of equal height.

Operation—FIG. 14*d*

The process of operation for FIG. 14*c* is the same as for the main embodiment.

The following are minor variations of the main embodiment:

Description—FIG. 14*e*

Referring to FIG. 14*e* the drawing shows a perspective view of another additional embodiment. Still referring to FIG. 14*e*, the embodiment has two decorative borders 34, one at each reversible side 30 and 31 of the embodiment. Two pieces of material of equal height are used. Crease a short distance above one horizontal seam 22*a* or 22*b*. Secure that position by stitching the area left unstitched 26. A decorative border will result at the top, and another at the bottom of the other reversible side.

Operation—FIG. 14*e*

The process of operation for FIG. 14*e* is the same as for the main embodiment.

Description—FIG. 14*f*

Referring to FIG. 14*f* the drawing is a perspective view of another additional embodiment. This embodiment has no decorative borders 34. Two pieces of material of equal height are used. Fold 25 across at the first and second horizontal seam 22*a* and 22*b*. Secure that position by stitching the area left unstitched. Both first and second reversible sides of FIG. 14*f* look like FIG. 6, the main embodiments' first reversible side 30, which has no decorative border.

Operation—FIG. 14*f*

The process of operation for FIG. 14*f* is the same as for the main embodiment.

Figure 15:
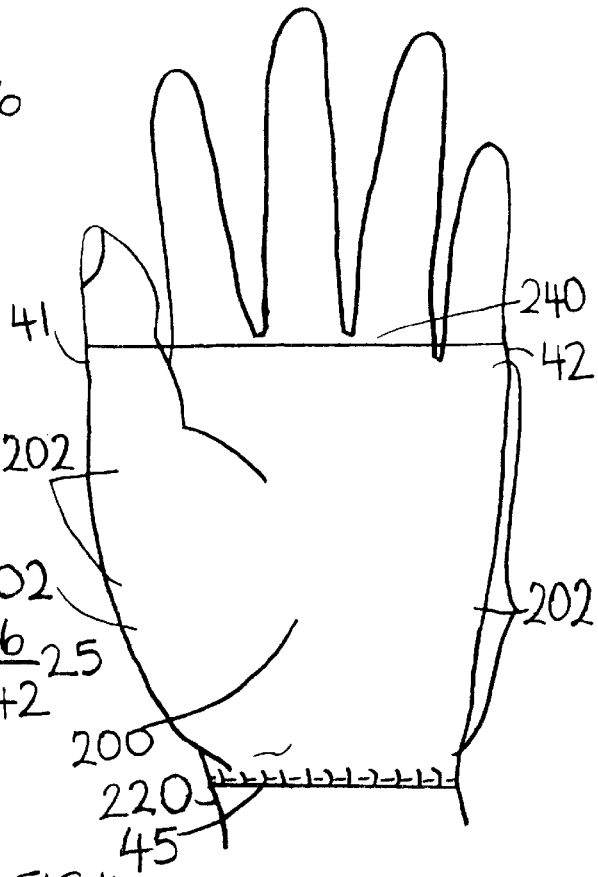
FIG. 15 is a plan cutaway view, coverage of a palm of another embodiment.

Description of Alternative Embodiments, Tapered Protector and Organizer—FIG. 15

Referring to FIG. 15 the drawing shows a perspective view of an alternative embodiment. It has a final tapered open end 45 and additionally, two fasteners are used at one end. The manufacturing process for this additional embodiment is the same as for FIG. 11*g* except for the fasteners at the narrowed open end 36.

Operation of Alternative Embodiments, Tapered Protector and Organizer—FIG. 15

The operation for this embodiment is the same as FIG. 11*g*

It is to be understood that someone skilled in the art may be able to determine better methods of manufacture, materials, and modifications, and therefore the multipurpose organizer and protector is not limited to the precise details of the structure shown and described in the specification, and does not limit the scope of the invention.

Advantages

From the descriptions above, the numerous advantages of my new invention become evident:

(a) It can be worn with only one movement of the hand and foot, and allows freedom of the fingers and thumb.

(b) This new product gives the right amount of coverage when it is needed, and where it is needed the most.

(c) It is ambidextrous, covers the entire area of the palm, including the ball of the thumb, and does not restrict with tight finger and toe slots.

(d) It is athletic-looking, washable, looks great with both casual and evening wear, and therefore has wide acceptance.

(e) It can be worn from any one of its two openings and therefore saves time.

(f) It is small enough not to need folding, and therefore saves space on any trip.

(g) It fits comfortably on the left and right palm of a hand, and the left and right toes of the feet.

(h) At any time of the year, the hands and area of a foot used to tip toe can be protected: the right product for the right job.

(i) Finally, beach goers can maintain their dignity on the hot sands and hot surfaces.

(j) Drivers have more protection against getting scorched on the palms and thumbs.

(k) It can be worn over conventional palm and toe coverings and protectors to add better coverage or protection.

(l) It keeps people smiling, because now they have a weapon against filth in a public working and recreational environment.

(m) It replaces the need for shopping for several separate products, and therefore saves gas money.

(n) This product provides the wearer with a high level of utility.

(o) An alternative embodiment with one narrowed open end resulting from using fasteners, reduces heat loss by limiting cold air into that opening.

(p) An alternative embodiment with a narrowed open end resulting from using fasteners reduces the chances that hot sand will enter that opening.

(q) An alternative embodiment using a mold results in a seamless structure, reducing stitching time and labor.

(r) An alternative embodiment using a mold with one tapered open end does not usually require fasteners, so time, labor, and cost of supplies are decreased.

(s) An alternative embodiment using a mold with one tapered open end also reduces heat loss by allowing very little cold air to enter from that end, and so increases maximum warmth potential.

(t) An alternative embodiment with one tapered open end resulting from a mold using fasteners, also prevents sand from entering at that end.

(u) Some embodiments save steps in manufacturing.

(v) An alternative embodiment using reversible material saves cost of materials.

(w) Other embodiments using machine-tooling save labor costs, as well as manufacturing time.

Other Embodiments

According to the drawings and specifications, there are numerous other embodiments of the multi-purpose organizer and protector. These other embodiments are manufactured from various different elements, which can be categorized into a matrix. The most basic elements of these embodiments are their rectangular, square, and wedge-shape. Also, the embodiments can be made from either one or two pieces of material.

The following is a list of some of the elements of the possible embodiments:

Reversible material, reversible material pre-fabricated to size, stretchable material, knitted stretchable cotton material, woven stretchable cotton material, jersey material, spandex material, non-stretchable cotton material, perforated stretchable material, perforated non-stretchable material, absorbent material, non-absorbent material, reversible stretchable material, non-reversible stretchable material, non-reversible non-stretchable material, one piece of stretchable material, two pieces of material and one is stretchable, two pieces of material of equal height, two pieces of material one shorter than the other, fasteners used, no fasteners used, bright colored material, light colored material, bright colored decorative borders, light colored decorative borders, bright colored buttons, light colored buttons, bright and also light colored gadgets or trappings.

Other embodiments using very stretchable material have a closer fit at the wrist of a hand, and toes of the feet and do not require fasteners.

The above lists of variations in the elements that make the embodiments are only the minimum possible. With this in mind, the following are a few more possible embodiments:

An embodiment may be made solely to help battle health risks associated with exposure of a hand to undesirables. This version of the main embodiment is made out of material that is not very absorbable. Regular stitches instead of the longer stitches used for the box-shaped stitching can be used. Friction at the ends of the small area left unstitched caused by stuffing small garments into that opening will no longer be a concern. Therefore, the two-step double-stitching process of that area can either be omitted, or reduced. This embodiment can also be used to protect the feet.

Additionally, another embodiment can omit a further two steps by using material of equal height. Time and labor used to measure and cut a shorter or longer piece of material is eliminated. These versions of the embodiment may also be used strictly for wear on the hands and feet. Another version can then be made separately, solely for use as an organizer.

Another embodiment of the tapered multipurpose organizer and protector has two small areas that are left unstitched at its seams. Items are inserted into one opening and pulled out through the other opening. Items such as a scarf and a handkerchief can also be organized this way in lieu of using a pocket while in public.

Yet another embodiment of the tapered multipurpose organizer and protector does not unfold the wedge shapes. The edges of each tapered end are stitched closed. To stitch the two wedge shapes together at one side, the two pieces are first aligned at the seams created by stitching each tapered end. The same process is applied to the other side.

Even yet another embodiment of the tapered multipurpose organizer and protector also does not unfold the wedge shapes. The two wedge shapes are placed back-to-back, and stitched together at both sides. A beginner tapered open end is secured or stitched. An organizer feature can be attached at, or away from a seam.

Still yet another embodiment of the tapered multipurpose organizer and protector only unfolds one of the wedge shapes. One wedge shape is unfolded and creased along one side. The fold of this creased piece is placed over the fold of the other wedge shape. The two pieces are then stitched along the crease. The same process is applied to the other side.

Even still yet another embodiment is a combination of the preceding embodiment. The difference is that the two pieces are unfolded and stitched at one side. The stitching process for the preceding embodiment is then used to stitch the other side.

The following are some embodiments that are made out of one square or rectangular piece of material:

Another embodiment is made out of non-reversible material. The material is folded and stitched along the edges of its width. An opening is left between the stitching to create an area that is left unstitched. The material is then reversed onto its right side. Both ends are then placed together at the edges and stitched closed.

Another variation of the preceding embodiment is stitched completely along its width. It does not leave an area that is left unstitched at the width. An area is left unstitched at the joining of the two ends.

Yet another variation of the embodiment first is stitched at the two ends. Then, the material is folded in two and stitched along its width, on the same side of the material. A small area is left unstitched through which to invert the material onto its right side.

Even yet another variation of the embodiment is folded in two after joining the ends. The fold should be on the opposite side of the material. The edges of its width are creased, and stitched or sealed. To get an organizer feature for this embodiment, attachments such as a strip of material, a flexible cord, or elastic band can be stitched and secured to the embodiment. These attachments can be located away from the seam side or at the seam. Items can then be organized through the attachment, or combinations of them.

Besides embodiments made from one and two pieces of material, other embodiments can be made from more than two pieces or layers of material.

Further, other embodiments can be made by a machine tooling process. Suitable thread or yarn of varying widths, colors and textures can be used. The resulting embodiment is seamless.

All possible embodiments can also be made from a mold using plastic and combinations of plastic such as pleather. Pieces of the material may be joined by methods such as stitching, bonding, heat-sealing, and cementing. Also, all embodiments can have variations of at least one or two embodiments.

Also, all embodiments can have other, and additional decorative borders. A specific masculine and feminine look can be achieved by adding trimmings or decorations such as embroidery, lace, and other such paraphernalia or trappings, including buttons, and also of any color, quantity, shape, size, thickness, length, and width.

Conclusion, Ramifications, and Scope of Invention

Thus, the reader will see that variations of the multi-purpose organizer and protector are almost limitless. The reader can further see that this new invention is multi-purpose, reversible, ambidextrous, quick and easy to operate on the hand and foot. It is also obvious to the reader that the embodiments provide a high level of coverage to the palm of a hand, back of a hand, and the area of a foot used to tip toe. Additionally, the reader can see that its advantages can also benefit conventional palm, hand and toe coverings and protectors. The embodiment is economical, comfortable to wear, small and lightweight, and saves space on any trip.

Several additional advantages of the multi-purpose organizer and protector have become obvious to the reader:

The nature of the invention is such that it would be most beneficial to the military, as well as civilians.

It provides protection from cold weather, and also hot surfaces.

It fulfills a need that has not been completely satisfied by existing inventions.

It allows beach goers to preserve their dignity.

It is an aid to maintain hygiene, and gives peace of mind to the wearer.

Its advantages can benefit conventional palm, hand and toe coverings and protectors.

It is multi-purpose, and therefore invaluable to most households.

It serves as a novel organizer for haberdashery such as socks, underwear, and hosiery.

While my above description contains many specificities, these should not be construed as limitations on the scope of the invention but rather as an exemplification or illustration of some of the presently preferred embodiments of this invention. For example, the shape of the multi-purpose protector and organizer can be square, cylindrical, wedge shape, or a futuristic shape, and worn from either end of the embodiment. An example of a futuristic shape can be oval or angular, with oval or angular trimmings. The futuristic embodiment can also be made out of a square, rectangular, wedge-shaped, oval, circular, or angular piece of material.

Also, all possible embodiments can have their summer and winter versions, made out of suitable materials to accommodate warmer, and much harsher cold weather.

In addition, all possible embodiments can be tapered, and have one narrowed open end. All the above-described embodiments can have fasteners of any type, quantity, shape, color, length, width and thickness at any possible location of the embodiment. These fasteners can have other shapes such as circular, oval, trapezoidal, triangular, etc. All the embodiments can also have perforations at either one side, a part of the embodiment, or the entire area of the embodiment.

Therefore the scope of the invention should be determined by the appended claims and their legal equivalents, rather than by the examples given.

What I claim as my invention is:

1. A method of forming a cylindrical body comprising:

a) providing a rectangular fabric blank having two short sides and two long sides;

b) sewing the longer sides together and inverting the sewn piece forming a horizontal seam;

c) using said horizontal seam to provide an uninterrupted body of cylindrical construction having no holes to expose a thumb of a hand;

d) folding said uninterrupted body of cylindrical construction upon itself and stitching the shorter sides together;

e) forming a vertical seam with said shorter sides when stitched together;

f) meeting the horizontal and vertical seams at a juncture and stop joining the vertical seam approximately one or two inches from said juncture;

g) leaving an area unstitched in the vertical seam after said juncture, and stitching at corners thereof with a plurality of stitches;

h) inverting the body through said small area that is left unstitched rolling the inverted body upon itself such that said horizontal seam appears approximately one inch from the edge of the body and providing a boarder or cuff.

2. A tubular garment for wearing on an appendage comprising:

an uninterrupted body of cylindrical construction providing a vertical seam and a horizontal seam, said horizontal seam lying perpendicular to a vertical seam, said vertical seam folded upon itself and having a plurality of stitches at he junction or corner of an unstitched inner area, said unstitched inner area located approximately one or two inches from an inner wrist end, said inner wrist end providing said unstitched inner area unobvious form the external unit of said uninterrupted body of cylindrical construction, having no holes therethrough and said uninterrupted body of cylindrical construction formed from a fabric of flexible construction.

* * * * *